US007703405B2

(12) United States Patent
Bridgeman et al.

(10) Patent No.: US 7,703,405 B2
(45) Date of Patent: Apr. 27, 2010

(54) METHOD OF PRODUCING A FIRE RESISTANT FABRIC WITH STITCHBONDING

(75) Inventors: William M. Bridgeman, Grand Rapids, MI (US); Jeffrey W. Siffert, Chesterfield, VA (US); Leon Green, Pompano Beach, FL (US)

(73) Assignee: Waubridge Specialty Fabrics, LLC, Chester, VA (US)

( * ) Notice: Subject to any disclaimer, the term of this patent is extended or adjusted under 35 U.S.C. 154(b) by 887 days.

(21) Appl. No.: 11/525,379

(22) Filed: Sep. 22, 2006

(65) Prior Publication Data

US 2007/0087642 A1 Apr. 19, 2007

Related U.S. Application Data

(60) Provisional application No. 60/719,346, filed on Sep. 22, 2005.

(51) Int. Cl.
*D05B 93/00* (2006.01)
*B32B 3/06* (2006.01)

(52) U.S. Cl. ..... 112/475.17; 428/102; 442/414

(58) Field of Classification Search ..... 112/475.08, 112/475.17; 428/102; 442/402–407
See application file for complete search history.

(56) References Cited

U.S. PATENT DOCUMENTS 3,806,959 A 4/1974 Gross
4,198,494 A 4/1980 Burckel
4,282,283 A 8/1981 George et al.
4,675,226 A * 6/1987 Ott ..... 428/102
4,941,884 A 7/1990 Green
5,083,617 A 1/1992 Pierce, Jr.
5,490,567 A 2/1996 Speer
5,496,625 A 3/1996 Lilani
5,503,916 A 4/1996 Ichibori et al.
5,534,325 A 7/1996 Jörder et al.
5,560,990 A 10/1996 Ilg et al.
5,582,912 A 12/1996 McCullough, Jr. et al.
5,618,623 A 4/1997 Nakajima et al.
5,628,066 A 5/1997 Gottlieb et al.
5,694,981 A 12/1997 Stanhope et al.
5,824,614 A 10/1998 Gadoury
5,849,648 A 12/1998 Kent et al.
5,853,880 A 12/1998 Kent et al.
5,888,652 A 3/1999 Berbner et al.
5,918,453 A 7/1999 Kent et al.
5,935,882 A 8/1999 Fujita et al.

(Continued)

FOREIGN PATENT DOCUMENTS

DE 19617634 11/1997
GB 2104929 3/1983

*Primary Examiner*—Ismael Izaguirre
(74) *Attorney, Agent, or Firm*—Hunton & Williams

(57) ABSTRACT

A washable fire-resistant fabric and a method for making a washable fire-resistant fabric comprises a lightweight pliant non-woven batt blended from two types of fire-resistant organic fibers which are non-irritating to human skin. A method for stitch bonding a pliant batt of intertwined fire-resistant fibers to form a fabric which is durable and resistant to unraveling is also provided. The fabric has fire-resistant properties wherein the fabric prevents the ignition of articles made therefrom when exposed to high heat or flame sources and further insulates a wearer of the clothing from high heat or flame sources to prevent serious burns.

25 Claims, 3 Drawing Sheets

U.S. PATENT DOCUMENTS 6,102,128 A 8/2000 Bridgeman
6,214,058 B1 4/2001 Kent et al.
6,269,759 B1 8/2001 Zafiroglu et al.
6,277,469 B1 * 8/2001 Wildeman ..... 428/167
6,287,686 B1 9/2001 Huang et al.
6,297,178 B1 10/2001 Berbner et al.
6,397,401 B2 6/2002 Belcher
6,407,019 B1 6/2002 Schäfer et al.
6,489,256 B1 12/2002 Kent et al.
6,516,472 B2 2/2003 Gessner et al.
6,551,951 B1 4/2003 Fay et al.
6,764,971 B2 7/2004 Kelly et al.
6,770,581 B1 * 8/2004 DeMott et al. ..... 442/312
6,930,064 B2 8/2005 Hartgrove et al.
7,259,117 B2 * 8/2007 Mater et al. ..... 442/414
7,589,037 B2 * 9/2009 Handermann et al. ..... 442/414
2002/0034906 A1 3/2002 Berbner et al.
2003/0082972 A1 5/2003 Monfalcone, III et al.
2004/0096629 A1 5/2004 Aneja et al.
2004/0097156 A1 5/2004 McGuire et al.
2004/0106347 A1 6/2004 McGuire et al.
2004/0158924 A1 8/2004 Frandsen-Anderson et al.
2004/0185731 A1 9/2004 McGuire
2004/0198125 A1 10/2004 Mater et al.
2005/0144728 A1 * 7/2005 Jones et al. ..... 5/698

* cited by examiner

METHOD OF PRODUCING A FIRE RESISTANT FABRIC WITH STITCHBONDING

CROSS-REFERENCE TO RELATED APPLICATION

This application claims the benefit of U.S. Provisional Application Ser. No. 60/719,346, filed Sep. 22, 2005, entitled FIRE-RESISTANT FABRIC, the entire contents of which are incorporated herein by reference. This application is related to the following co-assigned, co-invented U.S. patent application Ser. No. 11/525,405, entitled FIRE-RESISTANT FABRIC, filed on even date herewith.

BACKGROUND OF THE INVENTION

The present invention relates to fire-resistant fabrics which may be used, for example, in the making of clothing. For example, heat and flame resistant fibers are used to produce fire-resistant clothing for firefighters. Firefighting clothing, such as fire turnout gear utilized by fire departments, generally comprise overgarments which are manufactured and specifically designed to protect a firefighter while fighting a fire. Firefighting apparel exhibiting excellent fire-resistancy is expensive. The materials used in firefighting apparel include fibers from the aramid family, such as fibers marketed under the NOMEX® and KEVLAR® trademarks, and even higher-technology, higher-cost fibers such as polyimide fibers marketed under the trademark P84® and the like. However, the fire-resistant fabrics used in the outer layer of firefighting clothing typically are not soft, pliable, or friendly to human skin.

Clothing, and in particular children's clothing such as pajamas, are often labeled as fire-retardant. However, clothing so labeled and the fabrics from which the clothing is made are not fire-resistant. The clothing and fabrics so labeled are generally made from either natural fibers such as cotton, or synthetic fibers such as ORLON® and rayon. These fibers and fabrics made therefrom are typically flammable in nature. To label clothing made from these fibers as fire-resistant, manufacturers treat the fibers with chemical compounds in an attempt to alter the flammability characteristics. However, the chemical compounds used in such treatments generally do not alter the flammability of the fibers or fabrics, but rather operate to delay or lengthen the time between the exposure of the fabric to high heat and the point at which the fabric will ignite.

Therefore, there is a need for a fire-resistant fabric from which clothing can be made which will not ignite when subjected to a source of intense heat, and which is also soft and pliant so as to be non-irritating to human skin.

SUMMARY OF THE INVENTION

One aspect of the present invention is a fire-resistant fabric including a lightweight, pliant, non-woven batt blended from melamine fire-resistant organic fibers and modacrylic non-combustible organic fibers, in a ratio of melamine to modacrylic of about 80/20 to about 40/60, which is non-irritating upon contact with human skin. In certain embodiments, the fabric contains no more than 10% by weight of other types of fibers, and in other embodiments, no more than 5% by weight of other types of fibers.

Another aspect of the present invention is a method for making a fire-resistant fabric including the steps of combining approximately equal portions of melamine fire-resistant organic fibers and modacrylic non-combustible organic fibers, forming the fibers into a non-woven batt of intertwined fibers, stitch bonding the batt of intertwined non-woven fibers, and forming the stitch bonded batt into clothing or household articles.

Yet another aspect of the present invention is a method of stitch bonding a batt of intertwined non-woven fire-resistant fibers using both chain stitches and tricot stitches to form a fire-resistant fabric which is washable, durable, and resistant to unraveling.

These and other features, advantages, and objects of the present invention will be further understood and appreciated by those skilled in the art by reference to the following specification, claims, and appended drawings.

DETAILED DESCRIPTION OF PREFERRED EMBODIMENT

Figure 2:
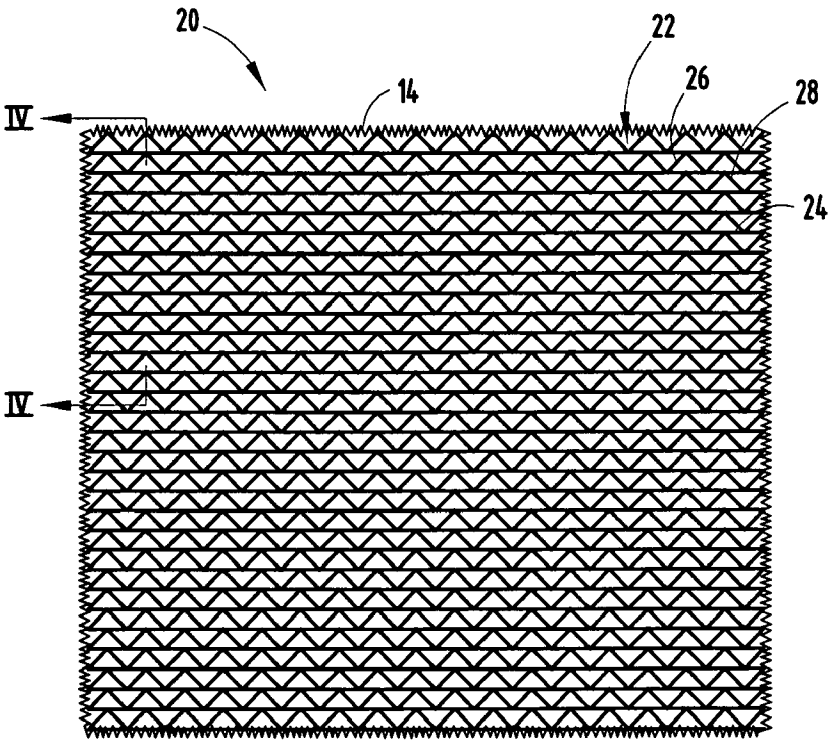
FIG. 2 is a top plan view of a section of fabric showing a plurality of proximate rows of "chain" and "tricot" stitches from the stitch bonding process.

For purposes of description herein, the terms "upper," "lower," "right," "left," "rear," "front," "vertical," "horizontal," and derivatives thereof shall relate to the invention as oriented in FIG. 2. However, it is to be understood that the invention may assume various alternative orientations and step sequences, except where expressly specified to the contrary. It is also to be understood that the specific devices and processes illustrated in the attached drawings and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

According to one embodiment, a soft, fire-resistant fabric is comprised of two types of organic fire-resistant fibers. While there are numerous inorganic fibers which are also fire-resistant or non-combustible, such fibers possess a general characteristic of being an irritant to human skin, therefore rendering the use of such fibers undesirable in a fabric which is intended for human contact including clothing and other household articles, such as blankets, mattress pads, furniture fabrics, glove liners, aprons, pot holders, etc. Since one of the uses of the fabric according to the present invention is for clothing such as children's sleepwear, the fabric should be economical to produce, thereby making the clothing affordable for private individuals and, at the same time, washable and sufficiently lightweight and soft to facilitate the wearing thereof by young children. Therefore, in selecting the appropriate fibers for use in the fire-resistant fabric according to the present invention, additional characteristics other than fire-resistance are preferably taken into consideration.

As used herein, fire-retardant means the ability of a material to resist burning or supporting combustion, although it will eventually char to ashes. Fire-resistant means the material will not support flame. Although the present invention is directed to the fire-resistant fibers of melamine and non-combustible fibers of modacrylic, fire-retardant fibers may also be used. Although not wishing to be bound by theory, it is believed that the modacrylic fibers, which are acrylic fibers modified by adding halogens, give off halogens in the presence of high heat. This release of halogens acts to displace the oxygen around the high heat source thereby preventing and/or extinguishing the burning fabric. It is also believed that melamine acts the same way in the presence of high heat, but instead of releasing halogens, it releases nitrogen.

While many fibers possess the requisite fire-resistant characteristics desired of fibers which are used in clothing, bedding, and other applications contacting human skin, these fibers may also have inherent characteristics which lessen their desirability for such use. For example, some of the organic fibers which are fire-resistant also display characteristics of extremely high strength, and thus are difficult to cut and cause excessive wear on shears and on the looms used to weave the fire-resistant fabric. Other fibers, while displaying fire-resistant characteristics, may tend to either shrink or melt at elevated temperatures. These characteristics decrease the desirability of the fiber for the desired uses. Also, candidate fibers of the fire-resistant category are often times relatively expensive when compared to other fibers. Thus, the selection of one or more fibers becomes dependent upon a number of characteristics in order to produce a fabric which is economical, lightweight, and safe for repeated everyday human use, yet will serve in a fire emergency situation to protect and shield an individual from serious burns. Typically, the organic fire-resistant fibers suitable for use in the preferred embodiment are members of the aramid, polyimide, or melamine families.

Melamine, also known as 2,4,6-triamino s-triazine, and melamine-based resinous fibers display desirable heat stability, solvent resistance, low flammability, low heat transference, and high-wear performance characteristics. These fibers are adaptable for processing on standard textile manufacturing equipment for the formation of a variety of fabrics, such as woven, knit, and non-woven products. The melamine fibers, in addition to their high degree of fire-resistancy, contribute to the pliability, softness, and general suitability for contacting human skin. The fibers may be used at a continuous temperature of 200° C. and exhibit a maximum use temperature range of 260-370° C., while exhibiting minimal shrinkage at elevated temperatures. One form of the melamine fiber is a synthetic polymer formed by condensation synthesis reactions of melamine with formaldehyde. Initially in the condensation reaction, methylol compounds are formed, which then react with one another to form a three-dimensional structure of methylene ether and methylene bridges. This melamine fiber is marketed under the name BASOFIL®, available from Basofil Fibers, LLC, Charlotte, N.C.

The polyimide family of fibers is probably the most widely known of the organic fibers for its strength and heat resistant characteristics. In particular, the aromatic polyimide family, also known as aramids, has a combination of high strength, toughness, and thermal stability. The aramid fibers are manufactured from a long-chain synthetic polyimide in which at least about 85% of the imide (—CO—NH—) linkages are attached directly between two aromatic rings. The more well-known aramids display high fire-resistant characteristics in that the fibers do not melt, but rather decompose at rather high temperatures of approximately 450° C., thus making the aramid fibers suitable for use in applications requiring fire-resistancy. One form of such an aramid fiber is marketed under the name KEVLAR®, available from DuPont Chemical, Spruance, Va. Other fire-resistant aramid fibers are marketed under the name NOMEX®, available from DuPont Chemical, Richmond, Va.; P84®, available from Degussa Inspec Fibres GmbH, Lenzing, Austria; and TWARON®, available from Teijin Twaron USA, Inc., Conyers, Ga.

Acrylic fibers are well-known in the synthetic fiber and fabric industries, as are modified acrylic fibers (modacrylic). Non-combustible modacrylic fibers are made from resins that are copolymers of acrylonitrile and other materials, such as vinyl chloride, vinylidene chloride, or vinyl bromide. Modacrylic fibers are modified to exhibit heat resistance, although the extent of the heat resistance is somewhat less than melamines. Such modacrylic fibers exhibit higher melting temperatures, e.g., 100-125° C. or higher as compared to 90-100° C. for acrylics not so modified, and higher deflection temperatures under load, e.g., 190-221° F. at 264 p.s.i. as compared to 160-190° F. for acrylics not so modified. However, modacrylic fibers are relatively inexpensive, and in combination with other fibers improve the affordability in the manufacturing of a fire-resistant fabric, which is comfortable and non-irritating when it comes into contact with human skin. Suitable non-combustible modacrylic fibers include PROTEX® and KANECARON®, both available from Mitsui Lifestyle (U.S.A.), Inc. of New York, N.Y.

While any one of the above fibers in and of itself is a potential candidate to create a fire-resistant fabric for use as a blanket (according to one embodiment), a blend of fibers from the above group will contribute desirable characteristics and enhance the affordability while maintaining its fire-resistant performance when combined into a fabric.

While a fabric comprising approximately equal proportions of melamine fiber, aramid fiber, and modacrylic fiber exhibits high strength and thermal resistance, it has been found that such fabrics have a yellowish color and are not easily dyeable. It has been have discovered that an excellent fire-resistant fabric having characteristics more like most clothing fabrics, including dyeability, can be made from a combination of melamine fiber and modacrylic fiber, in ratios of melamine-formaldehyde fiber and modacrylic fiber from about a 80/20 ratio of melamine/modacrylic to about a 40/60 ratio. In certain embodiments, a preferred ratio is from about 70/30 to about 60/40, and more preferably about 65/35. In certain embodiments, the melamine and modacrylic fiber fabric contains no more than 10% by weight of other types of fibers, more preferably no more than 8% of other types of fibers, and most preferably no more than 5% by weight of other types of fibers, e.g., aramid fibers, cotton fibers, rayon fibers or the like. Fibers that may be employed other than melamine-formaldehyde and modacrylic fibers include other fire-resistant fibers, such as aramids. However, in another aspect of the invention, the fabric is substantially free of aramids.

Figure 1:
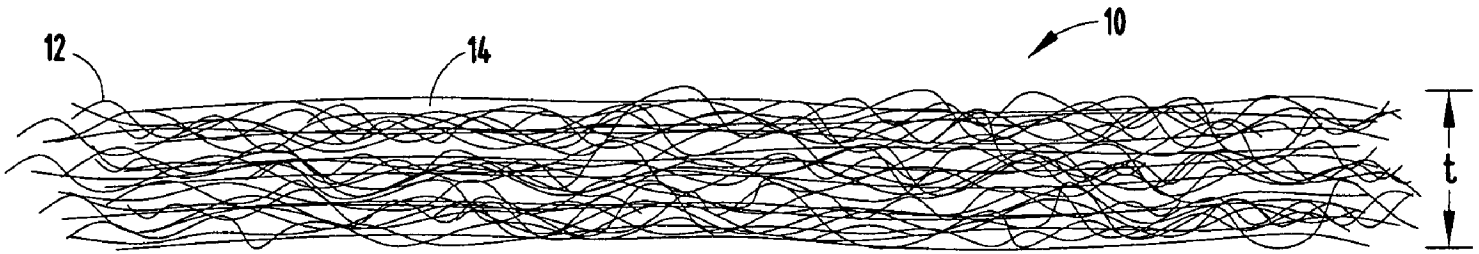
FIG. 1 is a side view of a section of fabric according to the present invention prior to stitch bonding, showing the non-woven intertwining of the fibers.

Referring now to FIG. 1, a non-woven batt of fabric is shown generally at 10 wherein a plurality of fibers 12 are combined in a non-woven fashion to form a substantially flat section of material 14 which is of a general uniform thickness, t. Fibers 12 are generally combined in such a way so that each of the different types of fibers is substantially uniformly dispersed throughout material 14. Fibers 12 are combined in a non-woven manner by a process known in the industry as "needling." In the needling process, fibers 12 are combined and uniformly distributed in their relative desired proportions and delivered to the needling apparatus whereby a plurality of needle-like projections engage and intertwine fibers 12 in such a manner as to substantially interlock the fibers to form material 14 in its desired thickness t. The needling process creates material batts that are more compressed and have less loft than the raw needled material 14, which enhances the thermal insulative properties of the produced material. In one preferred embodiment, needled material 14 is from about ⅛ to about 7⁄16 inch thick and weighs approximately four to about ten ounces per square yard. In another preferred embodiment, needled material 14 is approximately 3⁄16 inch thick and weighs approximately six to seven ounces per square yard.

Because the fibers 12 are not woven but are merely intertwined, a fabric produced by this process does not lend itself to repeated washings, since the washing action tends to disengage some of the intertwined fibers whereby the fibers become dislodged one from the other. As such, the material tends to deform, pull, and become generally unsightly, thereby rendering it less suitable for use. This is avoided in the preferred embodiment by stitch bonding the non-woven materials.

Figure 4:
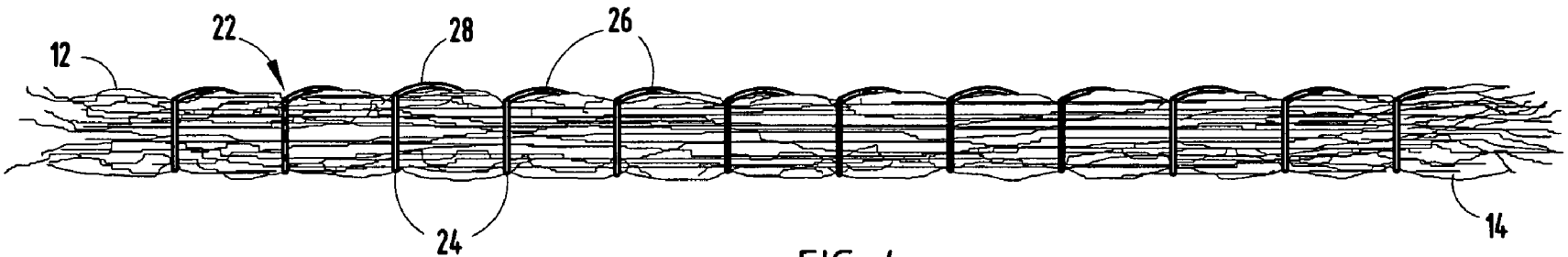
FIG. 4 is a cross-sectional view taken along the lines IV-IV of FIG. 2 showing the stitch bonding retaining the non-woven fibers in place.
Figure 3:
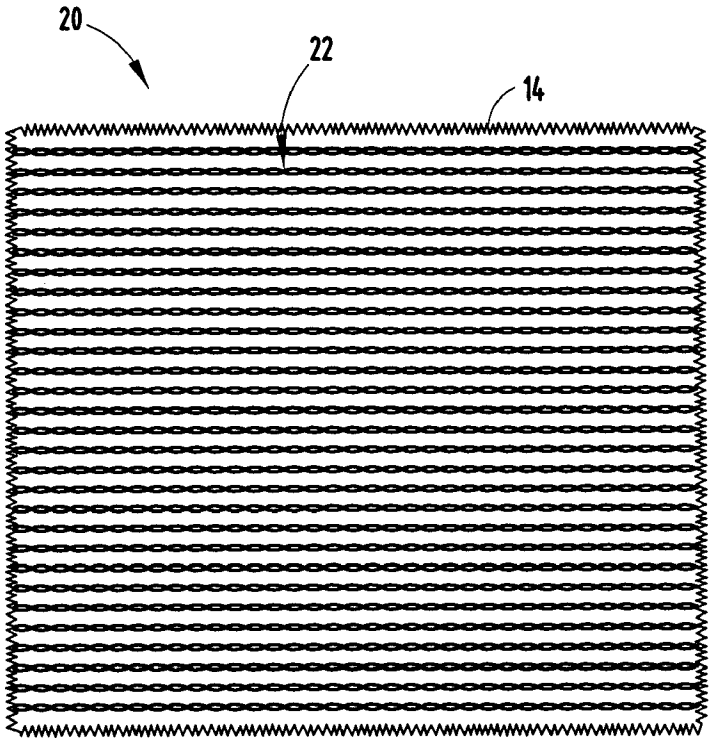
FIG. 3 is a bottom plan view of a section of fabric showing a plurality of proximate rows of stitches from the stitch bonding process.

Referring now to FIGS. 2-4, a finished fabric 20 includes a needled section of non-woven material 14 further comprising a plurality of parallel rows 22 of stitching. This process is known in the industry as stitch bonding and is used primarily to bond together a plurality of layers of material, wherein all or part of the layers are woven. The parallel rows 22 include "chain" stitches 24 and "tricot" stitches 26. The tricot stitches 26 exhibit a zigzag or herringbone pattern in which the stitching threads on one surface of material 14. Although the rows of chain stitches 24 and of tricot stitches 26 are proximately associated, in a preferred embodiment, the chain stitches 24 and tricot stitches 26 are physically connected. In another preferred embodiment, stitching rows comprise parallel rows 22 of chain stitches 24 and tricot stitches 26, wherein the rows 22 are spaced at approximately ⅐ inch intervals. While the completed fabric 20 after stitch bonding is more compressed and has less loft than the raw needled material 14, the stitch bonded finished fabric 20 now becomes washable on a repeated basis without the deterioration of the interlocked relationship of fibers 12.

The fabric 20, which has been stitch bonded using both chain and tricot stitches, has a smoother surface than prior fire-resistant fabrics. In addition, the combination of chain and tricot stitching pattern yields a fire-resistant fabric which is sturdier, more durable, and more aesthetically pleasing. Also, the combined chain and tricot stitching pattern enhances the interlocked relationship, making the fire-resistant fabric less likely to unravel if cut or pulled.

FIG. 4 illustrates (in cross section) a plurality of rows 22 of stitching wherein the thread 28 of the stitching captures and traps the intertwined fibers 12 to prevent them from dislodging. In one embodiment, thread 28 is a flat or textured polyester thread. Although the polyester thread is not fire-resistant and may melt when subjected to high temperatures, when it does melt, it tends to make the fabric 14 more "fluffy," or have a slightly higher loft. It is presently believed that the increase in loft actually increases the fire-resistance by providing additional air spaces within the fabric material 14.

Instead of utilizing a polyester thread, a fire-retardant or fire-resistant yarn may also be used to stitch bond the non-woven pliant section of intertwined fibers. This can either be, for example, polyester thread which has been chemically-treated or yarn made from fire-resistant fibers, such as melamine or aramid fibers. Chemically-treated polyester fire-resistant yarn will disintegrate, but not as quickly as a yarn that has not been chemically-treated. When subjected to high heat, yarn made from fire-resistant fibers would char, but not sustain flame. In a preferred embodiment, the fabric 14 is stitch bonded using a fire-resistant yarn made from fire-resistant fibers and would resist melting, thereby retaining the stitch bonding and durability of the fabric.

The stitch bonding as disclosed herein can be used with any fire-retardant or fire-resistant fabric, including a fabric using the composition of the preferred embodiment and the composition disclosed in U.S. Pat. No. 6,102,128, which is hereby incorporated by reference.

Figure 5:
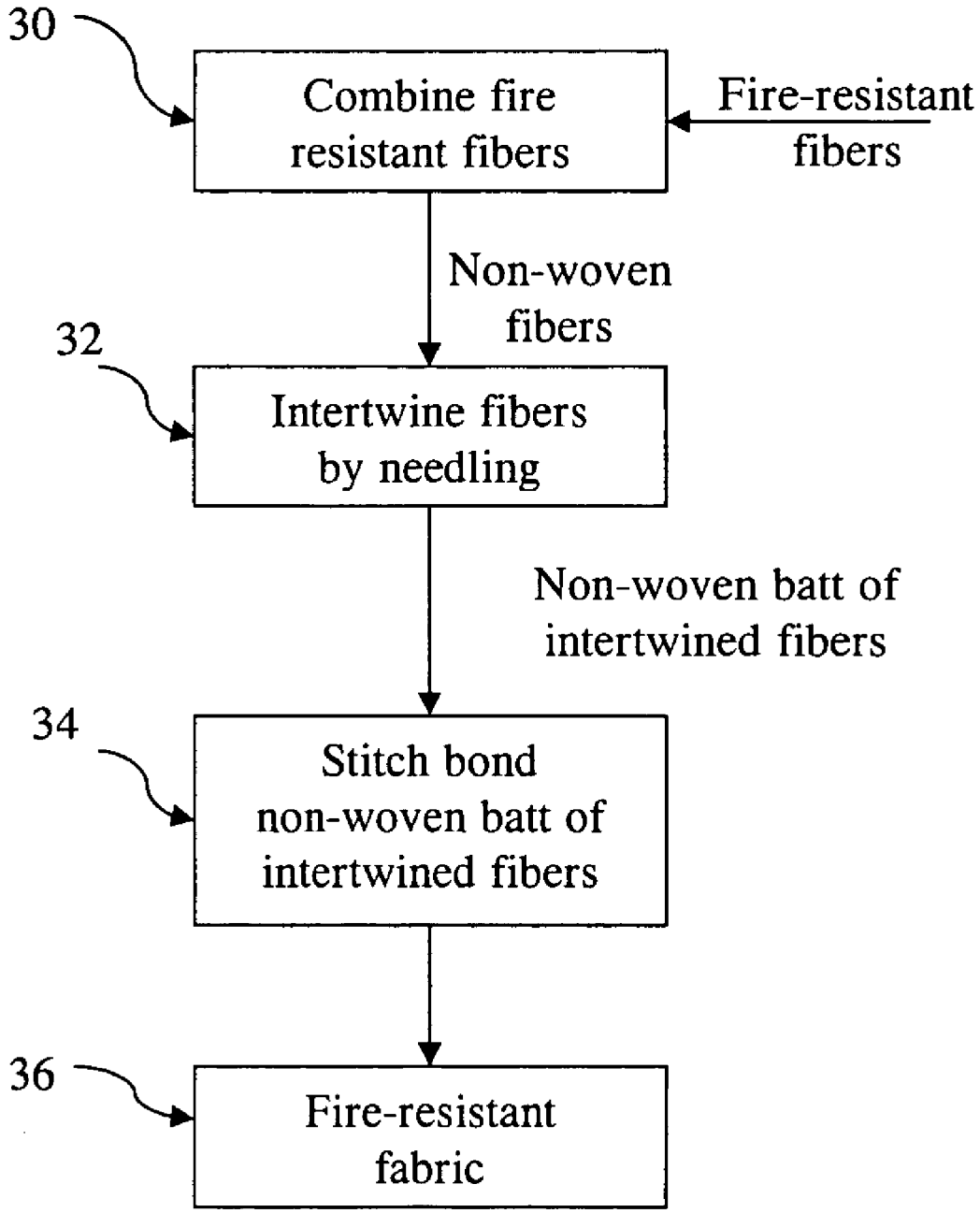
FIG. 5 is a flow chart illustrating a method for making a fabric according to one embodiment of the present invention.

FIG. 5 illustrates a method for creating a fire-resistant fabric according to the present invention and includes combining fire-resistant fibers 30 to form non-woven fibers. In one preferred embodiment, approximately equal portions of melamine fire-resistant organic fibers and modacrylic non-combustible organic fibers are combined. Next, the combined fibers are needled 32 into a non-woven batt of intertwined fibers. The batt of intertwined non-woven fibers are stitch bonded 34 as discussed above to form a fire-resistant fabric 36. The fire-resistant fabric 36 may then be optionally packaged as bolts of fabric to be cut and sewn into an article of clothing or blanket, for example.

The step of combining fire-resistant fibers 30 generally involves measuring out a predetermined amount of fire-resistant fibers. The fibers are combined and uniformly distributed in their relative desired proportions using wire rollers to form a section of non-woven fibers. The section of non-woven fibers is flattened out using a series of rollers having small needles.

Next, the non-woven fibers are sent to needling 32 where the non-woven fibers are further entangled. As discussed above, the needling apparatus includes a plurality of needle-like projections which engage and intertwine fibers such that the fibers are substantially interlocked to form a material in a desired thickness. After needling, material sections are more compressed and have less loft than the raw needled material, which enhances the thermal insulative properties of the produced material.

The batt of intertwined non-woven fibers are stitch bonded 34 as discussed above to form a fire-resistant fabric 36. Optionally, after stitch bonding, a heated roller may be applied to the surface of the fire-resistant fabric 36. The heated roller partially melts the fibers, thereby increasing the stability of the fabric. Typically, the heated roller is applied to only one side of the fabric.

The inventive fabrics, which are produced according to the preferred embodiments, and the methods of creating a fabric of the present invention, are easily produced because of their ability to be easily manufactured. This includes the ease with which the fibers may be handled and/or processed as well as the lower wear characteristics of the material on the machinery itself. Further, by producing a fire-resistant fabric which is dyeable and/or printable, as well as comfortable and non-irritating when it comes into contact with human skin, the commercial applications are greatly increased. Additionally, since the fabric is non-woven, the complicated manufacturing steps related to the weaving process are removed and replaced with a less complicated and lower cost fabrication step of stitch bonding, thereby rendering the non-woven fabric more durable and washable. The fabric so produced may be further manufactured into garments or other useful items which may come into repeated or prolonged contact with human skin without causing discomfort, and which require periodic washing. For example (but not limited to): fire-resistant clothing such as children's pajamas; firefighting clothing, such as turnout gear; blankets; sleeping bags; glove liners, aprons, pot holders, or any other product wherein fire-resistancy and non-irritating contact with human skin is desired. Of course, the fabric of the present invention may also be used in products and situations wherein non-irritation of human skin is not a requirement, such as curtains, rugs, upholstery fabric and the like.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A method for making a washable fire-resistant fabric comprising the steps of:

providing a melamine fire-resistant organic fiber, a modacrylic non-combustible organic fiber, and about 0% to about 10% by weight of other fire-resistant fibers including fibers selected from the group consisting of cotton fibers, rayon fibers, and mixtures thereof, wherein the ratio of the melamine fire-resistant organic fiber to the modacrylic non-combustible organic fiber is from about 80/20 to about 40/60 and wherein the other fire-resistant fibers are substantially free of an aramid fiber;

combining the melamine fire-resistant organic fiber, the modacrylic non-combustible organic fiber, and the other fire-resistant fibers in a non-woven batt;

providing a thread for use in stitch bonding the non-woven batt; and stitch bonding the non-woven batt with the thread.

2. The method of claim 1, wherein the combining step comprises needling the melamine fire-resistant organic fiber, the modacrylic non-combustible organic fiber, and the other fire-resistant fibers.

3. The method of claim 1, wherein the ratio of the melamine fire-resistant fiber to the modacrylic non-combustible fiber is about 60/40.

4. The method according to claim 1, wherein the thread is selected from the group consisting of a polyester thread, a chemically treated polyester thread, and a yarn made from fire-resistant fibers.

5. The method according to claim 1, wherein the action of stitch bonding the nonwoven batt comprises forming a row of chain stitches and a row of tricot stitches, wherein the row of chain stitches is parallel to, and proximately associated with, the row of tricot stitches.

6. The method according to claim 1, wherein the row of chain stitches and the row of tricot stitches are spaced at approximately 1/7 inch intervals.

7. The method according to claim 1, wherein the row of chain stitches is parallel and physically connected to the row of tricot stitches.

8. A method for making a washable fire-resistant fabric comprising the steps of:

providing a melamine fire-resistant organic fiber, a modacrylic non-combustible organic fiber, and about 0% to about 10% by weight of other fire-resistant fibers including fibers selected from the group consisting of aramid fibers, cotton fibers, rayon fibers, and mixtures thereof, wherein the ratio of the melamine fire-resistant fiber to the modacrylic non-combustible fiber is from about 70/30 to about 60/40 and the other fire-resistant fibers comprises from about 0% to about 8% aramid fiber;

combining the melamine fire-resistant organic fiber, the modacrylic non-combustible organic fiber, and the other fire-resistant fibers in a non-woven batt;

providing a thread for use in stitchbonding the non-woven batt; and stitch bonding the non-woven batt with the thread.

9. The method according to claim 8, wherein the thread is selected from the group consisting of a polyester thread, a chemically treated polyester thread, and a yarn made from fire-resistant fibers.

10. The method according to claim 8, wherein the action of stitch bonding the nonwoven batt comprises forming a row of chain stitches and a row of tricot stitches, wherein the row of chain stitches is parallel to, and proximately associated with, the row of tricot stitches.

11. The method according to claim 10, wherein the row of chain stitches and the row of tricot stitches are spaced at approximately 1/7 inch intervals.

12. The method according to claim 10, wherein the row of chain stitches is parallel and physically connected to the row of tricot stitches.

13. A method for making a washable fire-resistant fabric comprising the steps of:

providing a melamine fire-resistant organic fiber, a modacrylic non-combustible organic fiber, and about 0% to about 8% by weight of other fire-resistant fibers, wherein the ratio of the melamine fire-resistant organic fiber to the modacrylic non-combustible organic fiber is from about 70/30 to about 60/40;

combining the melamine fire-resistant organic fiber, the modacrylic non-combustible organic fiber, and about 0% to about 8% by weight of other fire-resistant fibers;

needling the combined fibers into a non-woven batt of intertwined fibers;

providing a thread selected from the group consisting of a polyester thread, a chemically treated polyester thread, and a yarn made from fire-resistant fibers; and stitch bonding the non-woven batt of intertwined fibers with the thread to form a row of chain stitches and a row of tricot stitches, wherein the row of chain stitches is parallel and physically connected to the row of tricot stitches.

14. The method of claim 13, further comprising the step of applying a heated roller to a surface of the fire resistant fabric.

15. The method of claim 13, wherein the non-woven batt of intertwined fibers has a thickness of about 1/8 to about 7/16 inch and a weight of about four to ten ounces per square yard.

16. The method of claim 15, wherein the non-woven batt of intertwined fibers has a thickness of about 3/16 inch and a weight of approximately six to seven ounces per square yard.

17. The method of claim 13, wherein the other fire-resistant fibers include one or more selected from the group consisting of an aramid fiber, a cotton fiber, a rayon fiber, and mixtures thereof.

18. The method of claim 17, wherein the other fire-resistant fibers are substantially free of an aramid fiber.

19. The method according to claim 13, wherein the other fire-resistant fibers are aramid fibers.

20. The method according to claim 13, wherein the row of chain stitches and the row of tricot stitches are spaced at approximately 1/7 inch intervals.

21. The method according to claim 13, wherein the row of chain stitches is parallel and physically connected to the row of tricot stitches.

22. A method for making a washable fire-resistant fabric comprising the steps of:

providing a melamine fire-resistant organic fiber, a modacrylic non-combustible organic fiber, and about 8% by weight of an aramid fiber, wherein the ratio of the melamine fire-resistant organic fiber to the modacrylic non-combustible organic fiber is about 65/35;

combining the melamine fire-resistant organic fiber, the modacrylic non-combustible organic fiber, and the aramid fiber;

forming the combined melamine modacrylic, and aramid fibers into a non-woven batt of intertwined fibers;

providing a stitching thread for stitchbonding the batt of intertwined fibers; and stitch bonding the batt of intertwined fibers with the stitching thread to form a row of chain stitches and a row of tricot stitches, wherein the row of chain stitches is parallel and physically connected to the row of tricot stitches.

23. The method according to claim 22, further comprising the step of applying a heated roller to a surface of the fire resistant fabric.

24. The method of claim 22, wherein the non-woven batt of intertwined fibers has a thickness of about 1/8 to about 7/16 inch and a weight of about four to ten ounces per square yard.

25. The method according to claim 24, wherein the non-woven batt of intertwined fibers has a thickness of about 3/16 inch and a weight of approximately six to seven ounces per square yard.

* * * * *